US005325616A

United States Patent [19]

Valiulis

[11] Patent Number: 5,325,616

[45] Date of Patent: Jul. 5, 1994

[54] LABEL HOLDER FOR DISPLAY HANGERS

[75] Inventor: Stanley C. Valiulis, Rockford, Ill.

[73] Assignee: Southern Imperial, Inc., Rockford, Ill.

[21] Appl. No.: 33,010

[22] Filed: Mar. 18, 1993

[51] Int. Cl.[5] ..... G09F 3/10

[52] U.S. Cl. ..... 40/299; 40/642; 40/657; 211/54.1

[58] Field of Search ..... 40/124.1, 299, 642, 40/657; 211/54.1, 57.1

[56] References Cited

U.S. PATENT DOCUMENTS

| | | | |
|---|---|---|---|
| 3,912,084 | 10/1975 | Valiulis . | |
| 3,977,109 | 8/1976 | Berry, Jr. et al. . | |
| 4,104,817 | 8/1978 | Herzog | 40/657 |
| 4,394,909 | 7/1983 | Valiulis et al. . | |
| 4,463,510 | 8/1984 | Windish . | |
| 4,715,135 | 12/1987 | Fast . | |
| 4,791,742 | 12/1988 | Stover | 40/299 |
| 4,823,964 | 4/1989 | Lundberg | 211/57.1 |
| 5,088,606 | 2/1992 | Boas | 211/57.1 |
| 5,123,189 | 6/1992 | Fast et al. | 40/299 |

FOREIGN PATENT DOCUMENTS

| | | | |
|---|---|---|---|
| 390587 | 4/1933 | United Kingdom | 40/657 |

*Primary Examiner*—Brian K. Green
*Attorney, Agent, or Firm*—Leydig, Voit & Mayer

[57] ABSTRACT

A label holder for use with a display hanger includes an elongated plastic strip, a mounting flange folded downwardly from the rear end of the strip, and a label-holding tab folded downwardly from the front end of the strip. Side wings are folded downwardly from the side edges of the strip and impart longitudinal stiffness to the strip. The lower edges of the forward portions of the side wings are scalloped and help retain merchandise in uniformly spaced relation on the front portion of the display hanger.

4 Claims, 1 Drawing Sheet

LABEL HOLDER FOR DISPLAY HANGERS

BACKGROUND OF THE INVENTION

This invention relates to a device adapted for use with an elongated merchandise support hook (e.g., a "Pegboard" hook) to display information relating to merchandise supported on the hook. Devices of this general type are disclosed in Windish U.S. Pat. No. 4,463,510 and Fast U.S. Pat. No. 4,715,135.

In general, such devices are stamped from a sheet of relatively flexible plastic and comprise an elongated strip adapted to overlie the hook. A mounting portion is folded downwardly from the rear end of the strip and is adapted to be secured releasably to the hook in order to attach the device to the hook. Folded downwardly from the front end of the strip is a tab which is adapted to support a label that provides information (e.g., price, item name, etc.) relating to the merchandise on the hook. In many cases, the merchandise is packaged on a display card whose upper end is formed with a hole for receiving the hook.

Because the plastic from which the device is made is relatively flexible, the elongated strip which overlies the hook tends to flex longitudinally and droop near its forward end. In order to reinforce the blank against longitudinal flexure, the Fast patent suggests forming rows of longitudinal perforations or creases in the strip between its side edges and centrally of its width. According to the Fast patent, the perforations or creases promote transverse flexure of the strip into a bowed configuration when the strip is squeezed laterally so as to reinforce the strip against longitudinal flexure. With such an arrangement, it is necessary to provide means for perforating or creasing the center of the strip and, at least in the case of a perforated construction, to provide means for squeezing the strip laterally to produce the bowed configuration.

SUMMARY OF THE INVENTION

One of the objects of the present invention is to provide a device of the above type in which the strip is stiffened against longitudinal flexing in a relatively simple and inexpensive manner by side wings which also help hold the merchandise in uniformly spaced relation near the front of the hook.

A more detailed object is to achieve the foregoing by providing a device in which side wings are folded downwardly from the strip along preformed fold lines at the side edges of the strip, the lower edges of the wings being scalloped. By virtue of the folded down wings, the flat and rather flimsy strip is stiffened against both longitudinal flexure and transverse bowing. The scalloped lower edges of the wings serve as detents which engage the upper edges of the merchandise cards and help hold the merchandise in uniformly spaced relation near the front of the hook.

These and other objects and advantages of the invention will become more apparent from the following detailed description when taken in conjunction with the accompanying drawings.

DETAILED DESCRIPTION OF THE PREFERRED EMBODIMENT

Figure 1:
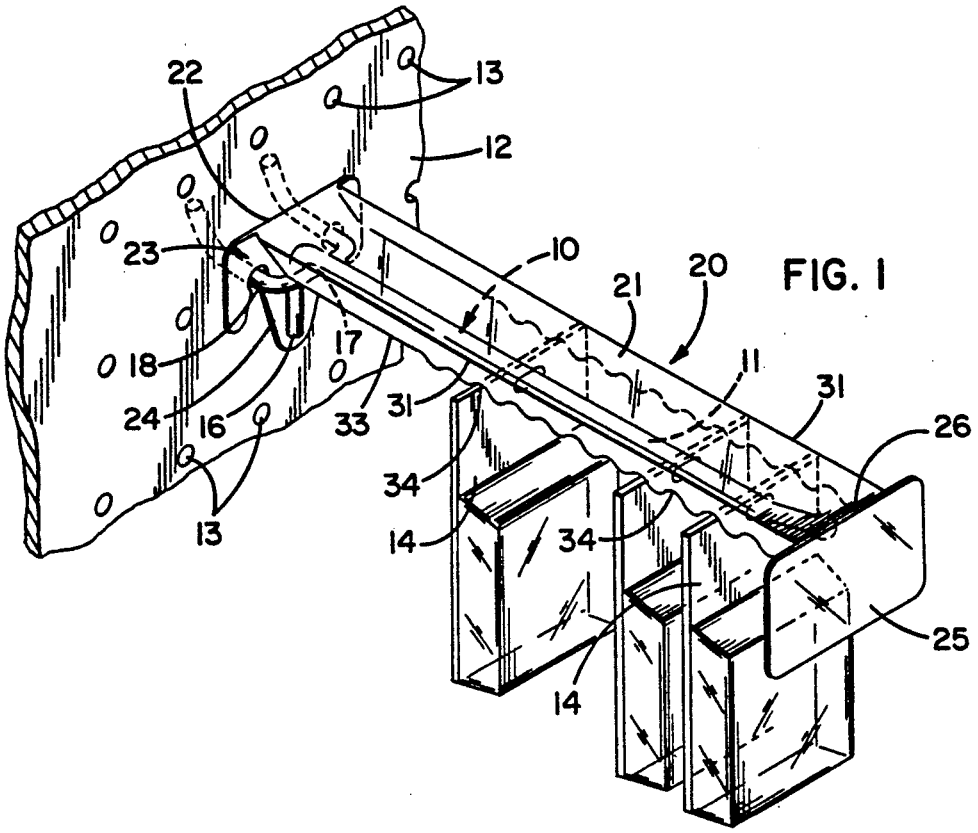
FIG. 1 is a perspective view of a display hanger equipped with a new and improved label holder incorporating the unique features of the present invention.
Figure 2:
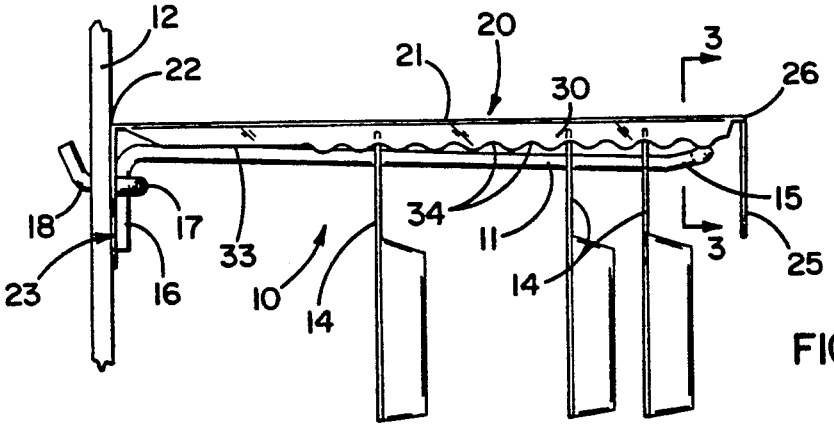
FIG. 2 is a side elevational view of the structure shown in FIG. 1.
Figure 3:
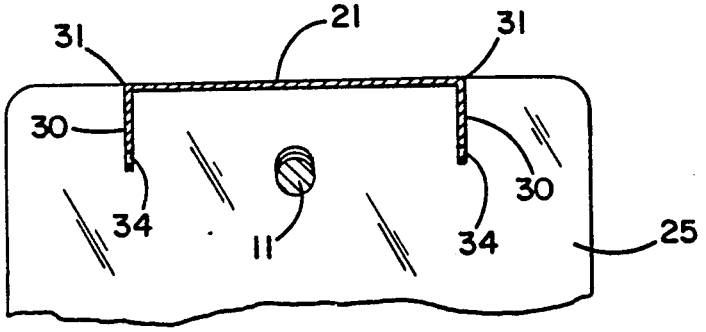
FIG. 3 is an enlarged fragmentary cross-section taken substantially along the line 3—3 of FIG. 2.

The present invention has been shown in the drawings as being associated with a hook or hanger 10 having a generally horizontally extending hanger arm 11 for supporting and displaying merchandise from a panel or Pegboard 12 of the type formed with a series of vertically spaced and horizontally extending rows of holes 13. The merchandise has been shown as being packaged on cards 14. The upper end portion of each card is formed with a hole to enable the card to be hung from the arm 11.

Herein, the hanger arm 11 is a metal rod-like element whose forward end portion or tip 15 is inclined upwardly at a slight angle so as to keep the cards from sliding horizontally off of the arm. Depending from the rear end of the arm is an integral finger 16. A round wire mounting piece includes a horizontal section 17 located beneath the rear end of the arm and welded to the forward side of the finger. Horns 18 are formed integrally with each end of the cross-piece 17. Each horn includes a horizontal portion projecting inwardly through a hole 13 in the panel 12 and further includes a vertical portion which hooks behind the rear side of the panel.

Associated with the hanger assembly is a device 20 for shielding the tip 15 of the hanger arm 11 and for holding a tag or label having printed information relating to the merchandise on the cards 14. Herein, the device is stamped from a sheet of flexible and relatively thin plastic and includes an elongated strip 21 which overlies the hanger arm 11. Formed integrally with and folded downwardly from the strip 21 along a preformed fold line 22 is a mounting flange 23 having a tongue 24 which fits between the panel 12 and the finger 17, the tongue also being located between the horns 18. Keyhole-shaped slots are formed through the flange on opposite sides of the tongue and receive the horns. Thus, the mounting flange 23 serves to attach the strip 21 releasably to the hanger 10.

Formed integrally with and depending from the front end of the strip 21 is a relatively wide tab 25 which is folded downwardly from the strip along a preformed fold line 26. The tab extends downwardly in front of the tip 15 of the hanger arm 11 and tends to shield the tip. In addition, a pressure-sensitive label (not shown) containing printed information relating to the merchandise on the cards 14 may be affixed to the front side of the tab. By hinging the strip 21 upwardly about the fold line 22, the tab 25 may be swung upwardly from the tip to enable the cards 14 to be placed on or removed from the arm 11.

Because the strip 21 is thin and flexible, and in some cases is relatively long, it lacks longitudinal stiffness and, in and of itself, tends to be flimsy. Longitudinal stiffness is imparted to the strip by side wings 30 which are integral with and extend downwardly from the side edges or margins of the strip. Herein, the side wings are folded downwardly from the strip along longitudinally extending and preformed fold lines 31 and are preferably located substantially perpendicular to the strip. Preferably, the side wings are coextensive in length with the strip.

The side wings 31 are resistant to flexing by vertical or edgewise forces applied to the wings in the plane thereof. As a result, the wings impart longitudinal rigidity to the device 20 and resist longitudinal flexing of the strip 21. In addition, the wings reduce the tendency of the strip to bow transversely and in fact resist transverse bowing of the strip.

In addition to stiffening the device 20, the wings 30 are used to help keep the cards 14 spaced uniformly from one another near the front of the hanger arm 11. For this purpose, at least the front portion of the lower edge of each wing is scalloped. Herein, approximately the front half of the lower edge of each wing is scalloped while the remainder of the lower edge is straight as indicated at 33. The wavy scallops define spaced detents or notches 34 along the lower edges of the wings. The upper edge portions of the cards 14 fit into and are retained by the notches and thus a uniform spacing may be maintained between cards at the forward portion of the hanger arm 11 so as to create a neat and well-organized display. Surplus cards near the rear of the arm 11 may be easily slid forwardly on the arm due to the straight rear edge portions of the wings.

From the foregoing, it will be apparent that the present invention brings to the art a new and improved label holding device 20 having unique side wings 30 which resist longitudinal flexing of the device while keeping merchandise neatly organized near the front of the hanger 10. The combined width of the strip 21 and the wings 30 is less than the width of the tab 25 and is the same as the width of the flange 23 and thus the wings are formed from plastic which otherwise would be wasted. Accordingly, the wings do not increase the material cost of the device. Moreover, the absence of creases or perforations in the strip 21 facilitates the removal of dust from the top of the strip.

I claim:

1. A combination of, an elongated merchandise support hook having front and rear portions, and a device for use with the support hook to display information relating to merchandise on the hook and to help hold the merchandise in spaced relation along the hook, said device comprising a single piece of plastic having an elongated strip overlying the hook, said strip having front and rear ends and having longitudinally extending side margins, a downwardly extending mounting portion integral with the rear end of said strip and releasably attached to the rear portion of the hook, a tab portion extending downwardly from the front end of said strip and adapted to support a merchandise information label, each of said side margins including integral means defining a downwardly facing lower edge having front and rear portions, at least the front portion of each of said lower edges being scalloped to help hold the merchandise in spaced relation along the front portion of the hook.

2. The combination defined in claim 1 in which said means comprise wings formed integrally with and depending from said side margins of said strip and substantially coextensive in length with said strip, each of said wings having a lower edge scalloped along at least part of a length of the wing.

3. The combination defined in claim 2 in which said wings are folded downwardly from the side margins of said strip along preformed fold lines to impart longitudinal stiffness to the strip and to resist transverse bowing of the strip.

4. The combination defined in claim 3 in which said wings extend substantially perpendicular to said strip.

* * * * *